US005394927A

United States Patent [19]

Huebner

[11] Patent Number: 5,394,927

[45] Date of Patent: Mar. 7, 1995

[54] RECREATION AREA BOUNDARY AND SAFETY RESTRAINING BARRIER

[76] Inventor: Robert W. Huebner, 191 Maple Ave., Meriden, Conn. 06450

[21] Appl. No.: 2,587

[22] Filed: Jan. 11, 1993

[51] Int. Cl.[6] ..... E06B 3/80

[52] U.S. Cl. ..... 160/327; 256/1; 256/45

[58] Field of Search ..... 160/351, 327, 328, 329, 160/332; 256/19, 45, 1; 135/117, 900, 902, 87; 472/94; 273/29 R, 29 B, 29 BB, 29 BC, 411

[56] References Cited

U.S. PATENT DOCUMENTS

| | | | |
|---|---|---|---|
| 1,116,554 | 11/1914 | Boggis . | |
| 1,641,246 | 9/1927 | Bassford | 273/29 BC |
| 2,009,329 | 7/1935 | Scherer | 273/29 B |
| 2,324,726 | 7/1943 | Sawyer | 160/327 |
| 2,785,897 | 3/1957 | Lennon . | |
| 3,388,909 | 6/1968 | Woods . | |
| 3,435,487 | 4/1969 | Mazzei et al. | 273/29 BC |
| 3,849,935 | 11/1974 | Hale . | |
| 3,982,758 | 9/1976 | Howes, Jr. . | |
| 4,030,733 | 6/1977 | Merrihew et al. . | |
| 4,088,317 | 5/1978 | Gierla . | |
| 4,105,190 | 8/1978 | Curtis | 256/1 |
| 4,717,157 | 1/1988 | Smith | 273/29 BC X |
| 4,893,668 | 1/1990 | Nomura | 160/327 |
| 5,106,101 | 4/1992 | McKay . | |

*Primary Examiner*—David M. Purol
*Attorney, Agent, or Firm*—Dilworth & Barrese

[57] ABSTRACT

A recreation area boundary and safety restraining barrier device and kit therefor is disclosed. The device includes a net having first and second edges, resilient net supports disposed near at least one of the first or second edges of the net for supporting the net, and support posts mounting the net in a substantially vertical orientation such that either the first or second edges thereof is in close proximity to the ground such that objects contacting the net are prevented from passing between the either first or second edges of the net and the ground. A kit is also disclosed containing at least two support posts, a length of netting material, and a length of resilient cord attachable to the netting material and the at least two support posts. The kit may further include at least two support post receiving sleeves.

2 Claims, 3 Drawing Sheets

RECREATION AREA BOUNDARY AND SAFETY RESTRAINING BARRIER

BACKGROUND OF THE INVENTION

1. Field of the Invention

This invention relates to safety restraining devices and more particularly to resilient recreation area safety restraining barrier devices and a kit therefor.

2. Description of the Related Art

One of the more demanding responsibilities for parents or guardians of young children, particularly for grandparents or other elderly guardians, is that of supervising the children during outdoor play activities. Even when watching children constantly, parents or guardians quite often cannot react fast enough to prevent children under their supervision from going where the parents or guardians do not want the children to go. In many instances the children are only chasing after rolling toys or balls to retrieve them.

A favorite spot for children to play while outdoors is on driveways, a usually substantially smooth paved surface which provides a good playing area for riding toys such as tricycles and playing with balls or the like. A common problem however during such activity is keeping the toys and balls from rolling down the driveway and into the street. This problem is magnified in many homes in which the driveway is sloped downwardly away from the house. For many children, their normal reaction is to follow the object in an attempt to retrieve it. By doing this, the children are placed in the obvious dangers associated with passing vehicular traffic. Parents or guardians, even if they are close by, cannot always get to children fast enough to prevent them from placing themselves in danger.

A related problem is that children, while playing, often lose regard for the boundaries that their parents or guardians may have set for a play area. Without a physical boundary to constantly remind children of their play area limits, children often lose regard for their guardian defined play area and gradually play further and further away from the area. Additionally, children, while riding on toys such as tricycles or the like, may go too fast and might not be able to stop on their own as they go down the driveway.

Some parents or guardians attempt to temporarily rectify these problems by placing a car across the driveway or erecting a temporary barrier out of plywood or the like. These barriers, however, are not always effective and sometimes are not as sturdy and reliable as they could be. Furthermore, children on riding toys or the like may become injured upon colliding with such barriers.

Apparatus exist which provide temporary fencing to serve as temporary barriers for a tennis court area. One such apparatus is disclosed in U.S. Pat. No. 3,982,758 issued to Howes, Jr. In the Howes, Jr. patent, a temporary tennis court net and surrounding fencing is disclosed using removable support posts and poles, respectively which are secured in steel or plastic sleeves embedded in the paved surface of a parking lot. The temporary netting provided in Howes, Jr. is draped across the surface of the pavement to prevent the escape of low flying or fast rolling tennis balls. The device in Howes, Jr., however, utilizes netting which is attached to and suspended between vertical poles without providing any cord or the like to suspend the net from. The netting, therefore, is held directly by the posts themselves in which case the netting provides a relatively rigid barrier.

A continuing need therefore still exists, for a temporary, resilient and removable device which will serve to retain toys, balls and similar play objects of children at play, within a desired area. A need also exists for a device which will serve as both a visual and physical boundary to keep children within an area as defined by their parents or guardians. Such a device should provide a boundary which will slow down and preferably, stop a child on a riding toy from going too far down a driveway or other play area while absorbing some or most of the shock of impact with the barrier. A still further need exists for a kit containing all the necessary components of the barrier system to facilitate easy and quick installation of the temporary barrier device.

SUMMARY OF THE INVENTION

The present invention provides a recreation area resilient safety restraining barrier device which comprises net means having first and second edges, resilient net support means disposed near at least one of the first or second edges of the resilient net means for supporting the net, and mounting means for mounting the net means in a substantially vertical orientation such that either the first or second edges is in close proximity to the ground such that objects contacting the resilient net means are prevented from passing between the either first or second edges of the net means and the ground.

In one embodiment, the mounting means includes at least two support posts mountable in the ground such that a portion of the at least two support posts remains above ground of sufficient height to support the net material therebetween.

Preferably, the resilient net support means includes at least one length of resilient cord material. Fastener means are provided which are attachable to at least one of a first end or a second end of the length of resilient cord material such that the resilient cord material is removably connectable to at least one of the support posts. Fastener receiving means are disposed on at least one of the support posts for receiving the fastener means of the at least one length of resilient cord material.

In a preferred embodiment, first and second resilient cords are provided each having a first end and a second end. The first and second cords are held by means disposed on the net for receiving and retaining the first and second resilient cords respectively therein such that the first and second ends of the resilient cords project outward from first and second ends of the length of netting material.

A kit containing a recreation area resilient safety restraining barrier device is also provided, comprising at least two support posts, a length of netting material, and a length of resilient cord attachable to the netting material and the at least two support posts. Preferably, the kit also comprises at least two support post receiving sleeves.

A method is disclosed for installing a recreation area resilient safety restraining barrier device is also comprising the steps of providing at least two support posts, a length of netting material, and at least one length of resilient cord attachable to the netting material and the at least two support posts; inserting the at least two support posts in the ground; and attaching the length of netting material having the at least one length of resilient cord attached thereto to the support posts such that the netting material is flexibly attached to the support posts.

BRIEF DESCRIPTION OF THE DRAWINGS

The foregoing as well as other advantages and features of the invention will become more readily apparent and may be understood by referring to the following detailed description of illustrative embodiments of the recreation area boundary and safety restraining barrier device and kit of the present invention, taken in conjunction with the accompanying drawings in which.

DETAILED DESCRIPTION OF THE PREFERRED EMBODIMENTS

Figure 1:
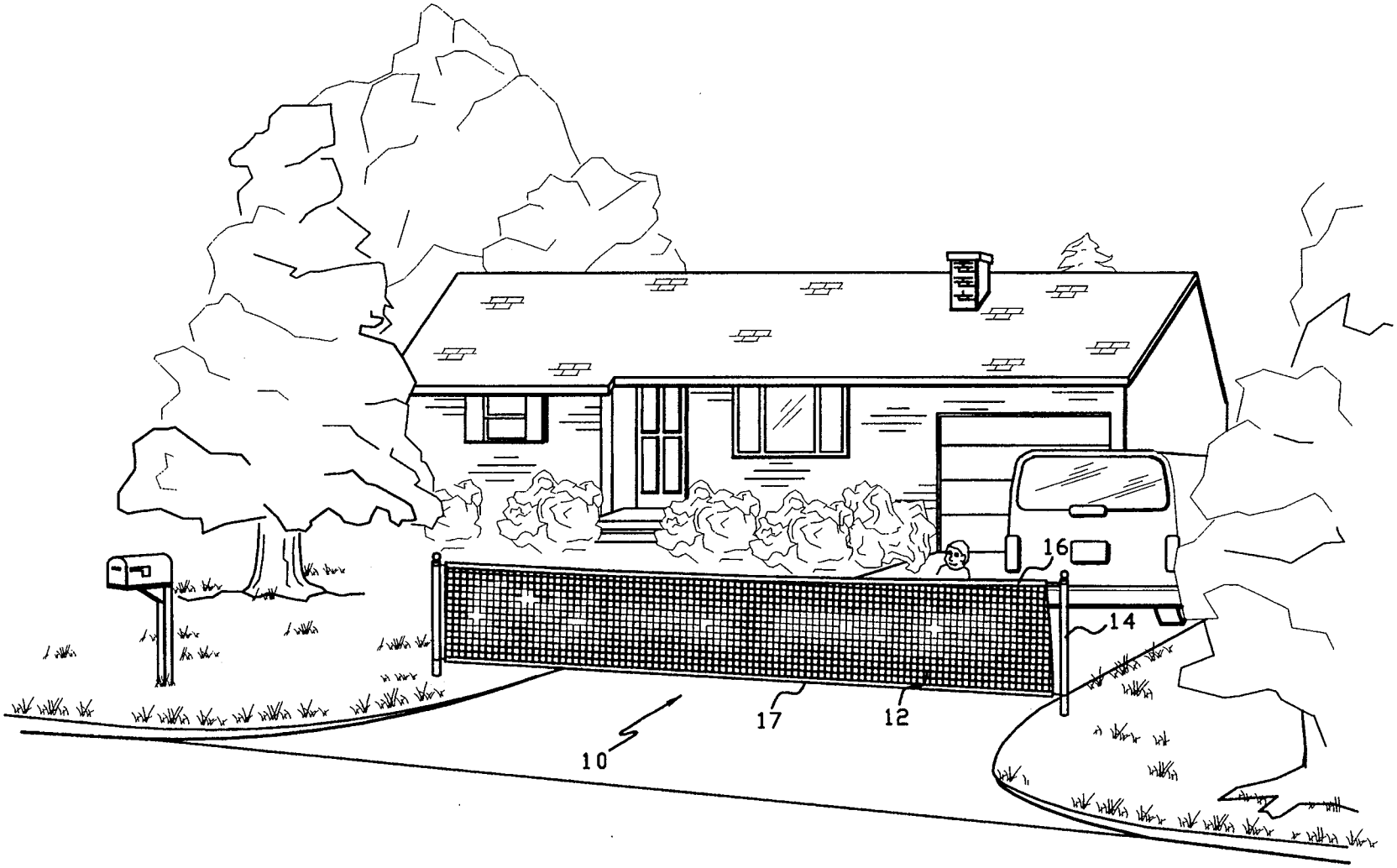
FIG. 1 illustrates one embodiment of the resilient barrier device of the present invention installed at the end of a driveway.

Referring now in specific detail to the drawings, in which like reference numerals identify similar or identical elements throughout the several views, and initially to FIG. 1 which shows the resilient barrier device of the present invention shown generally at reference numeral 10 as installed at the end of a representative driveway.

Briefly, the device includes net 12 suspended between removable mounting means, for example, support posts 13 and 14 by way of resilient net support means such as resilient cords 16 and 17. Aside from the netting material, the materials from which resilient barrier device 10 are constructed preferably comprise mainly aluminum or stainless steel for net support post elements and connecting hardware or fasteners. Alternatively, support posts 13 and 14 may be made of wood or durable plastic piping materials such as, for example, polyvinylchloride (PVC) piping. However, other suitable equivalent materials will readily come to the mind of those skilled in the art and may be substituted for any of the parts mentioned without departing from the scope of the present invention. Other materials will be referred to hereinafter where they differ from those already mentioned.

Net 12 may be made of any suitable netting material that will preferably not have openings large enough for toys or balls and the like or a small child's hand to be easily passed through. The material should, however, be sufficiently resistive of being torn or damaged by constant use or by exposure to the elements of nature. One netting material which has been found particularly useful is a heavy grade plastic netting such as CONWEB, a tradename for netting available from Internet of Atlanta, Ga. Such netting material is durable enough to withstand contact with moving objects such as children's toys or balls and the like while being resistive to destruction by rain, sleet or snow should the barrier device be left erected during long periods of time. The height and width of the netting may vary but is preferably wide enough so that users may cut one end so as to ensure covering the complete width of their driveway or other area desired to be blocked. A height that has been found effective is approximately three feet high for moderate play of younger children of approximately 2–5 years of age.

Figure 2:
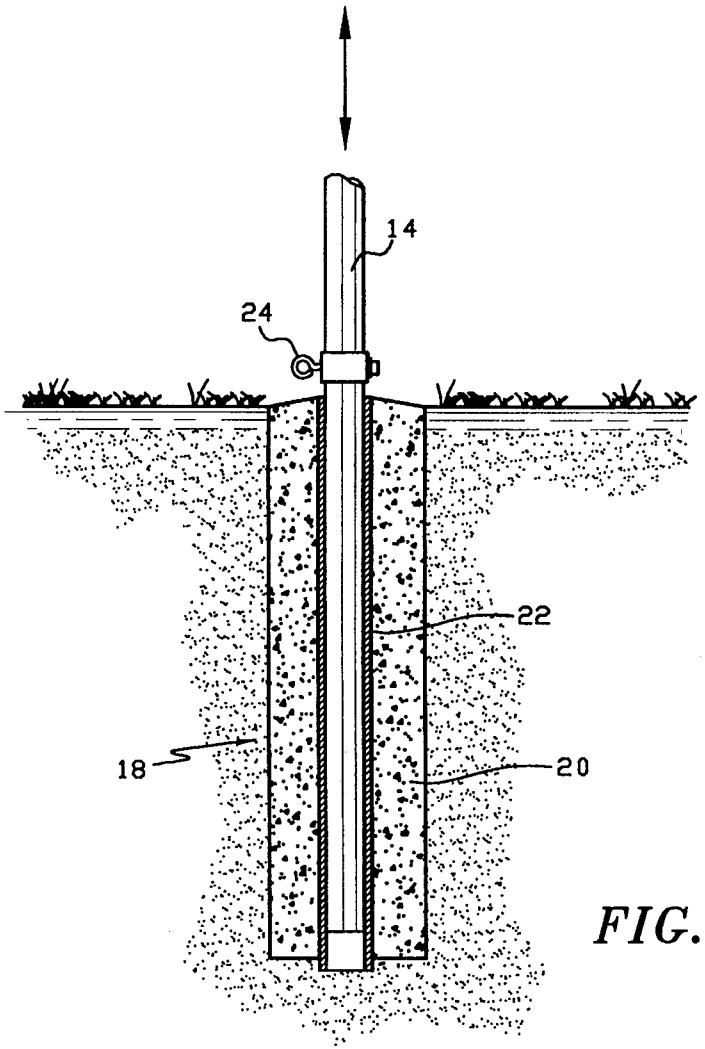
FIG. 2 is a partial view with the receiving sleeve shown in cross-section illustrating the installation of one of the receiving sleeves and support poles of the embodiment of FIG. 1.

Referring now to FIG. 2, support posts 13 and 14 are preferably inserted into receiving sleeves 18 such as shown. Receiving sleeves 18 are installed in the ground preferably on either side of a driveway near the bottom end thereof substantially as shown in FIG. 1. Sleeves 18 serve to provide a readily accessible hole to receive support posts 13 and 14 without requiring a hole be dug each time posts 13 and 14 are inserted.

The installation of receiving sleeves 18 may be accomplished by any suitable method to provide a firm support for support posts 13 and 14. One particularly suitable method of installing receiving sleeves 18 is by forming concrete sleeves around pipe material placed in holes dug into the ground. This method is disclosed in U.S. Pat. No. 3,982,758 issued to Howes, Jr., the entire contents of which are hereby incorporated by reference. Briefly, receiving sleeves may include a concrete sleeve such as the concrete sleeve 20 formed around a pipe material such as, for example, receiving pipe 22. Preferably, receiving pipe 22 is open at both ends, the first end for receiving a support post 13 or 14 and the second end for allowing drainage of water therethrough. Two holes are dug in the ground, one on each side of the driveway. Additional holes may be added to receive additional support posts in between the two outer extreme holes to provide additional support, for example, in the case of extra wide driveways. Each hole has a diameter sufficient to contain receiving pipe 22 and concrete sleeve 20. Receiving pipe 22 is inserted in the hole so that the top of the pipe is substantially flush with or slightly recessed in the ground so that receiving sleeves 18 do not pose a tripping hazard. Additionally, the receiving sleeves are formed flush with or recessed in the ground so that lawn maintenance equipment such as lawn mowers and the like may safely pass over the sleeve. Concrete is then poured around the pipe so it becomes fixed firmly in the ground once the concrete sets to form concrete sleeve 20.

Figure 3:
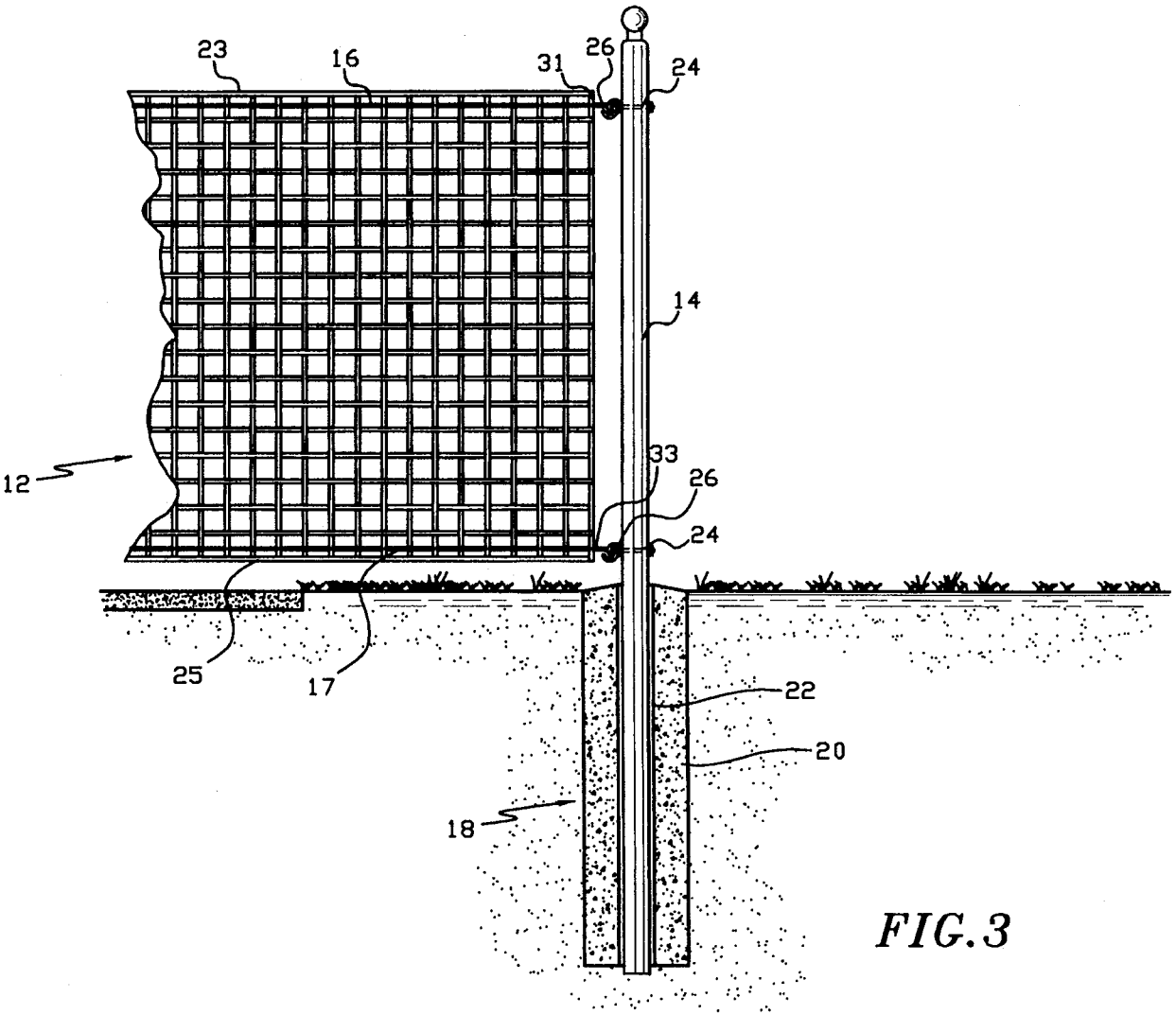
FIG. 3 is a partial view illustrating one end of the resilient barrier device of the present invention as installed with the receiving sleeve shown in cross section.

Referring now to FIGS. 2 and 3, support posts 13 and 14 are provided with holes for receiving fasteners such as eye-bolts 24 shown partially in phantom lines in FIG. 3. Particularly, a pair of diametrically opposed holes (not shown) are drilled through each of support posts 13 and 14 such that upon insertion of support posts 13 and 14 in receiving sleeves 18 the holes are near the tops of receiving sleeves 18. Any suitable fasteners such as eye-bolts 24 are inserted through the holes and secured in place by nuts. A second pair of holes is provided in each support post 13 and 14 near the top end thereof and an eye-bolt 24 is inserted therein and fastened as described above.

Net 12 is mounted to support posts 13 and 14 by way of resilient cords 16 and 17 woven through the openings of net 12 near first edge 23 and second edge 25, respectively and fastened at first ends 28 and 29 (FIG. 1) and second ends 31 and 33 of resilient cords 16 and 17 respectively, to eye-bolts 24 by suitable mounting means such as, for example, hooks 26. Resilient cords 16 and 17 may be made of any suitable elastic type expandable cord material. One cord material that has been found particularly suitable for the resilient barrier device 10 of the present invention is sold under the tradename SHOCK CORD available from T. W. Evans Cordage, Portsmouth, R.I. Hooks 26 may be attached at each end 28 and 29 and 31 and 33 of resilient cords 16 and 17, respectively. Other suitable fasteners may be readily substituted for hooks 26. In a preferred embodiment, however, one end of each resilient cord 16 and 17 are permanently attached to the top and bottom eye-bolts 24, respectively of one of support posts 13 or 14 to facilitate quick installation of resilient barrier device 10.

In a preferred embodiment, the above-described components of resilient barrier device are provided in a kit with the exception of the cement needed to form concrete sleeves 20. However, in other embodiments, the necessary cement may be provided in the kit. The resilient barrier device kit includes all of the components discussed above provided pre-cut and ready for installation, with the exception of net 12 and resilient cords 16 and 17 which are provided in one length which are to be cut by the user so as to achieve the proper fit for various sized driveways or other installation areas. Alternatively, numerous different kits may be made available which contain different size nets and resilient cords to accommodate some of the more common driveway widths. In those embodiments, all of the components of the kit as discussed above may be provided ready to be installed. In any of the embodiments, the kit may contain net material with the resilient cords already woven through the upper and lower ends of the net material.

Figure 4:
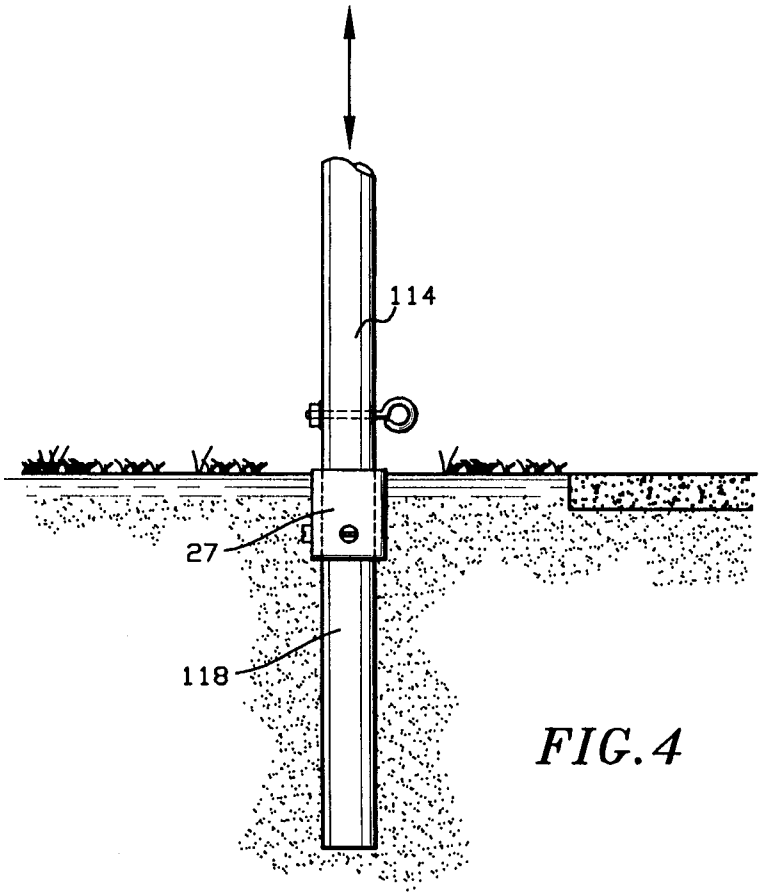
FIG. 4 illustrates an alternative installation of the receiving sleeve and support pole of the present invention.

Referring to FIG. 4, another embodiment of the installation of a receiving sleeve is shown with receiving sleeve 118 driven directly into the ground without the use of cement to form a support for receiving sleeve 118. Collar 27 is provided near the top of receiving sleeve 118 so as to add support and thereby strength to sleeve 118 near the junction with support pole 114.

INSTALLATION

The installation of resilient barrier device 10 for the embodiment in which one fixed length of netting and resilient cord material is provided in the kit of the present invention will now be described. After installing concrete receiving sleeves as described above, the proper length of netting needed is measured and the net material is cut sufficient to extend from one receiving hole to the other. Next, the resilient cord material is cut somewhat shorter than the length of the net material. Depending on the elastic properties of the particular resilient cord material provided with the kit, this length is usually approximately 1–2 feet less than that of the net for a net length of 15–25 feet. A separate chart may be provided with the kit of the present invention to inform the user with the optimal lengths to cut the resilient cord for a certain length of net or for a given span between support posts 13 and 14. Once the net and resilient cord materials have been cut to the appropriate length, a fastener such as hook 26 is affixed to the freshly cut ends of resilient cords 16 and 17. Support post 13 having net 12 already affixed thereto is placed in either of receiving sleeves 18 and the other end of net 12 is pulled in the direction of the vacant receiving sleeve 18. Loose support post 14 is inserted into the vacant receiving sleeve 18 with eye-bolts 24 oriented towards support post 13 which has net 12 already mounted thereon. The end of resilient cord 17 is stretched toward support post 14 and hook 26 is attached to eye-bolt 24 located near the bottom of support post 14. This procedure is repeated for the free end of resilient cord 16 which is attached by hook 26 to eye-bolt 24 located on support post 14 near the top of receiving sleeve 18. To disassemble the unit, the above steps are reversed except that the cutting of the net and resilient cord materials and the attachment of hooks 26 to the cord material need only be done prior to the first use.

Although the above procedure has been described for a kit containing two support posts, it is to be understood to be within the scope of the invention that for wider driveways or areas of installation, additional support posts may be necessary or desirable to provide additional support to the net and resilient cords.

While the invention has been particularly shown and described with reference to the preferred embodiments, it will be understood by those skilled in the art that various modifications in form and detail may be made therein without departing from the scope and spirit of the invention. Accordingly, modifications such as those suggested above, but not limited thereto, are to be considered within the scope of the invention.

What is claimed is:

1. Resilient safety restraining barrier device for for protecting an area for recreation purposes or the like, which comprises:

(a) first and second elongated resilient cords each having a first end and a second end;

(b) a length of netting material having at least a top edge and a bottom edge, each of said edges having means disposed thereon for receiving and retaining said first and second resilient cords respectively therein such that said first and second ends of said resilient cords project outward from first and second ends of said length of netting material without laterally tensioning said net means;

(c) first and second support posts adapted for insertion into apertures formed in the ground; and (d) means disposed near said first and second ends of each of said first and second elongated resilient cords for removably attaching said cords to said support posts.

2. Resilient safety restraining barrier device according to claim 1, further comprising receiving means disposed on said support posts for receiving said means for removably attaching said elongated resilient cords.

* * * * *